United States Patent [19]

McCausland et al.

[11] Patent Number: 4,597,734

[45] Date of Patent: Jul. 1, 1986

[54] SURFACE-COMBUSTION RADIANT BURNER

[75] Inventors: Dominick A. C. McCausland; Leslie C. Shirvill; Kenneth F. Coles, all of Chester, United Kingdom

[73] Assignee: Shell Oil Company, Houston, Tex.

[21] Appl. No.: 707,727

[22] Filed: Mar. 4, 1985

[30] Foreign Application Priority Data

Mar. 5, 1984 [GB] United Kingdom ..... 8405681

[51] Int. Cl.[4] ..... F23D 14/12

[52] U.S. Cl. ..... 431/328; 431/326; 126/92 AC

[58] Field of Search ..... 431/325, 326, 327, 328, 431/344; 126/92 AC, 92 R

[56] References Cited

U.S. PATENT DOCUMENTS

| | | | |
|---|---|---|---|
| 2,194,208 | 3/1940 | Moran | 431/328 |
| 4,285,665 | 8/1981 | Enga | 431/328 |
| 4,354,823 | 10/1982 | Buehl et al. | 431/328 |
| 4,373,904 | 2/1983 | Smith | 431/328 |
| 4,416,618 | 11/1983 | Smith | 431/328 |
| 4,435,154 | 3/1984 | Vigneau | 431/328 |
| 4,492,564 | 1/1985 | Wolf | 431/328 |
| 4,533,317 | 8/1985 | Addison | 431/100 |

FOREIGN PATENT DOCUMENTS

| | | | |
|---|---|---|---|
| 2267524 | 11/1975 | France | 431/328 |
| 1219877 | 9/1969 | U.S.S.R. | 431/328 |

OTHER PUBLICATIONS

"Catalyst Bed for Flameless Heaters", Research Disclosure, #153, (Jan., 1977).

*Primary Examiner*—Samuel Scott
*Assistant Examiner*—Helen Ann Odar

[57] ABSTRACT

A surface-combustion radiant burner comprising a frame 1 of impermeable material supporting a porous element 2 permeable to gas and conduit means 7 to conduct a combustible gas mixture into a gas distributing space 5 enclosed by the frame 1 and the porous element 2, the porous element 2 being formed of metal particles of an alloy containing iron, chromium and aluminum and having the property of forming an alumina layer on heating in the presence of oxygen. And, a method of using such a burner for burning gas and air mixtures at high temperatures while minimizing nitrogen oxide production and burner corrosion.

6 Claims, 2 Drawing Figures

SURFACE-COMBUSTION RADIANT BURNER

BACKGROUND OF THE INVENTION

The present invention relates to a surface-combustion radiant burner comprising a porous element for use in radiant appliances in which gaseous fuel, such as natural gas and LPG are used as fuel.

When in a surface-combustion radiant burner an air/-gas mixture is forced through an element having a large number of pores and is ignited near the downstream side of the element, the burning gases, in addition to producing heat by combustion, also produce a high proportion of radiant heat from the burner surface in the form of infrared rays. Heat-treatment processes continue to need faster heating rates and precision in heat application. In this connection surface-combustion radiant burners may be suitably used because of the possibilities of high heat transfer rates, silent operation and stable combustion over a range of gas/oxidant ratios from about 60 percent to 180 percent of the stoichiometric ratio.

The commercially available radiant burners normally have porous media formed of granulated ceramic material or ceramic fibers. A major requirement for radiant burners is the ability to withstand thermal shock and severe oxidative and corrosive conditions in a high temperature environment and under surface combustion conditions. Ceramic materials are known to have good oxidation and corrosion stabilities. Further advantages of ceramic materials or radiant heating appliances are the possibility of high heat transfer rates, silent operation and stable combustion over a wide range of fuel-/oxidant ratios. However, limiting conditions are the restricted ability of ceramics to withstand very high thermal and mechanical stresses which may be imposed. Another difficulty with ceramic elements is that they are fragile and easily broken.

To overcome the above disadvantages encountered with ceramic materials, it has already been proposed to use metals for radiant burners. Wholly metallic radiant burners have a great advantage over ceramic burners in that they are very robust and have a better thermal shock-resistance. The available metals such as austenitic and ferritic stainless steels, however, oxidize rapidly under surface combustion conditions where temperatures greater than 1200 K are encountered. Oxidation induced corrosion causes the resistance to flow of the porous elements to increase and this severely limits its useful life. The known metallic radiant burners are therefore limited to application under rather moderate temperature conditions.

The object of the present invention is to provide an improved surface combustion radiant burner with a metallic porous element having a high oxidation and corrosion stability under high temperature surface combustion conditions.

SUMMARY OF THE INVENTION

The surface combustion radiant burner according to the invention thereto comprises a frame of impermeable material supporting a porous element permeable to gas, and conduit means to conduct a combustible gas mixture into a gas distributing space enclosed by the frame and the porous element, wherein the porous element is formed of metal particles of an alloy containing iron, chromium and aluminum and having the property of forming an alumina layer on the metal surface upon heating in the presence of oxygen.

DESCRIPTION OF THE INVENTION

Figure 1:
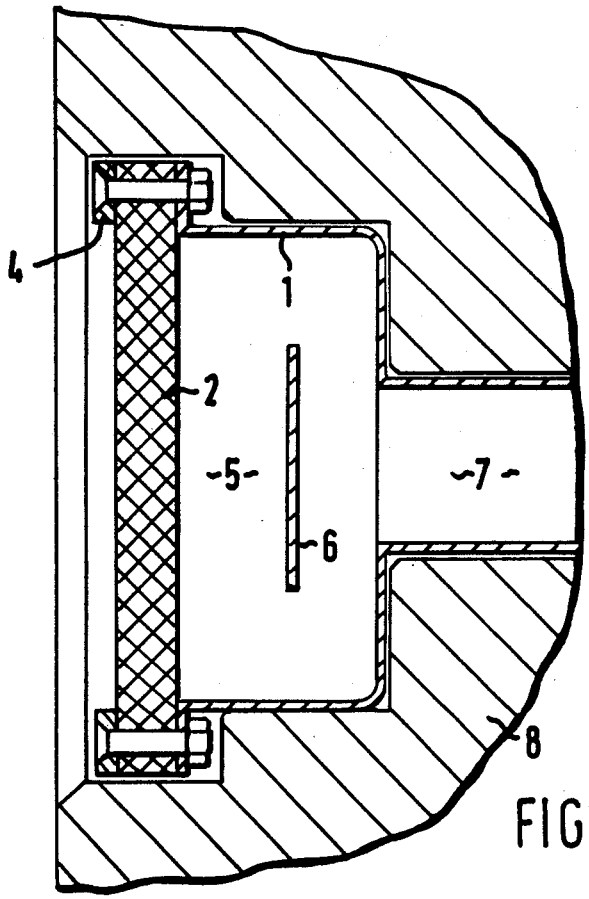
FIG. 1 is a section of a first burner according to the invention.

A main advantage of the burner according to the invention is the circumstance that, on heating, an alumina layer is formed on the surface which provides a high temperature corrosion resistance and prevents further oxidation of the porous element. The alumina layer has a further advantage in that any cracks formed in the alumina layer are self-healing in the presence of oxygen.

The alloy which is according to the invention used for the porous element of a radiant burner has a high oxidation resistance at high temperatures, particularly over the range 970–1470 K, in which radiant burners are normally operated. A further advantage of porous media made of the above alloy is that such porous elements are easily deformable, so that they can be easily configured to any one of a plurality of shapes.

In a suitable embodiment of the invention the allow further includes a minor quantity of yttrium, helping to form a stable and tenacious layer of alumina on heating. A suitable alloy for preparing the porous element comprises 15.0 to 22.0% w chromium, 4.0 to 5.2% w aluminum, 0.05 to 0.4% w yttrium, 0.2 to 0.4% w silicon, less than 0.03% w carbon and the balance iron. The metal particles forming the porous element are preferably in the form of fibers. The fibers may be woven or randomly packed to form a felt. Depending on the operational requirements one of the above configurations may be chosen. Fiber woven sheets have a slight advantage over fiber felt, in that woven sheets can be more accurately manufactured with a uniform distribution of the openings over the sheets. A uniform pore distribution of a porous element formed of a plurality of woven sheets allows a uniform distribution of combustible mixture over the whole area of the elements, enabling operation over a wide range of loads, without risk of unstable operation, flash back or overheating at local spots in the burner material. To minimize the thermal conductivity through the porous element, the fibers are laid in planes substantially normal to the direction of the flow during combustion.

For use at very high heat loads, preference is given to porous elements formed of fiber felt, since such a configuration the fibers are in relatively poor thermal contact with each other. Such elements preferably comprise substantially rigid panels of randomly laid fibers having diameters of about 22 $\mu$m and porosities of about 80 percent.

The frame part of the proposed burner is suitably made from a metal, such as stainless steel, and can be fabricated, pressed or otherwise formed into the required shape to support the porous element part and to form a plenum for the gas-mixture. The porous element can be secured to the frame part in any suitable manner, such as by bolting, locking or welding. If the burner is used in a furnace, the metal frame part should preferably be protected against overheating by encasing the frame in a body of a suitable refractory material, such as a body formed of sintered ceramic fibers.

Apart from the important advantage of having a superior oxidation resistance, there are further advantages in the operation possibilities of the proposed burner. During operation, the proposed burner was found to exhibit an unpredictable advantage, that of an improved radiant efficiency in combination with low $NO_x$ emission as compared to the prior art radiant burners, in particular those having porous elements formed of a granular ceramic material. The high radiant efficiency is attributable to the burner's uniform flow and heat release pattern, which most probably results from the uniform pore distribution of the porous media tested.

The proposed radiant burner type was further found to have a high turndown ratio of at least 10 to 1, which is considerably larger than that of the normally available radiant burners.

In FIG. 1 a burner frame 1 of a heat resistant metal such as stainless steel is shown. The frame supports a porous element 2 made of fibers of an alloy comprising iron, chromium and aluminum. Optionally, the fibers may be sintered. The porous element 2 is tightly secured to the burner frame 1 by means of bolted flanges 4. The burner frame 1 and the porous element 2 enclose a gas distributing space 5 provided with a distributing baffle 6 for uniformly distributing a combustible mixture introduced via an inlet 7 over substantially the total area of the porous element 2. For making the burner shown in FIG. 1 applicable for furnace operations, the burner frame 1 is encased in a body 8 of a refractory material.

Figure 2:
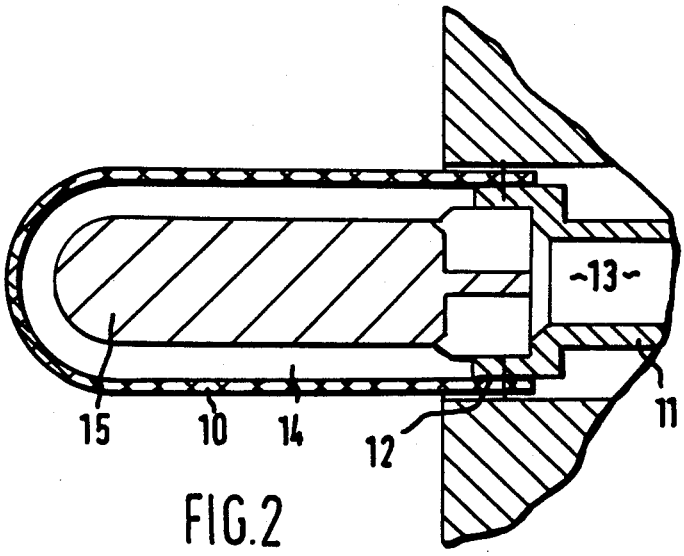
FIG. 2 is a section of a second burner according to the invention.

FIG. 2 shows an alternative of the first shown burner which is particularly advantageous for use in boilers where oil firing is replaced by gas. This further burner comprises a porous element 10 formed in the shape of a closed ended tube. The porous element is connected to a frame 11 by bolting. To ensure a gas tight connection between frame 11 and element 10, a gasket 12 is arranged between these burner parts.

The frame 11 is provided with a gas inlet 13 for supplying a combustible gas mixture into the distribution space 14 enclosed by porous element 10. To minimize mixture volume in space 14 a plug 15 is substantially centrally arranged in said distribution space 14. The plug 15 can be made from any impermeable material, such as metal.

The above configurations have been given by way of example only. It should be noted that the present invention is in no way restricted to a particular arrangement of the burner parts. The above examples are intended to demonstrate in which completely different ways the porous element may be shaped owing to the high ductility of the applied alloy.

The burner according to the invention may also be shaped as a tunnel burner having a combustion space enclosed by a porous element. Suitable examples of such tunnel burners are disclosed in Applicant's British patent specification Nos. 1.317.168 and 1.463.663.

The invention is further illustrated, but not limited, by the following examples of its use and operation.

EXAMPLES

A number of felt panels were manufactured according to a proprietary process, trade name Bekipor, from fibers of an iron, chromium and aluminum alloy, available under the trademark Fecralloy. The panels were formed from randomly laid fibers of $\mu$m diameter compressed to produce rigid panels of about 80 percent porosity. The labyrinth structure formed by the randomly laid fibers provides flow passages through the panels resulting in a high permeability. The permeability of the panels was determined from the measured pressure loss upon air flow through the panels. The viscuous (Darcy) permeability of the panels was found to be 101 $\mu m^{-2}$ (Darcies).

The panels were combustion tested into the open-air using stoichiometric natural gas/air mixtures over the thermal input range 100–2500 kW $m^{-2}$, based on the gross calorific value of the gas and the superficial area of the panel surface. As 200 kW $m^{-2}$ the panel surface became uniformly heated within seconds, the surface temperature (measured using a disappearing filament optical pyrometer) was 1050 K. At 100 kW $m^{-2}$ the panel surface also became uniformly heated but the temperature was below the lower limit of the pyrometer, 1020 K. Increasing the thermal input produced an increase in surface temperature to a maximum of 1160 K at 800 kW $m^{-2}$. Beyond 2000 kW $m^{-2}$ the flame was established not in the surface layers of the panel but above the surface in a multitude of free-flames, the panel surface remaining cool. Between 1000 and 2000 kW $m^{-2}$ there was a transition region where both surface-combustion and free-flame coexisted in patches due to slight non-uniformity of permeability.

Under uniform surface combustion conditions the mixture pressure increased from the equivalent air flowrate value by a factor of between 3.2 at 200 kW $m^{-2}$ and 1.6 at 1000 kW $m^{-2}$. Under complete free-flame conditions, $<2000$ kW $m^{-2}$, the mixture pressure when firing was the same as that obtained with the equivalent flowrate of ambient air.

For all stable operating conditions the temperature of the upstream surface of the panel remained below 320 K. Although the thermal conductivity of the used alloy is high, 28 W $m^{-1}$ $K^{-1}$ at 800 K, compared with ceramic materials, the effective thermal conductivity through the panel is very low because the fibers, which are in poor thermal contact with each other, are laid in planes normal to the direction of flow.

After several hours of testing in the surface combustion mode the panel permeability was remeasured but had not changed. To verify that prolonged heating would not adversely affect the permeability, one whole panel was calcined in air at 1400 K for a total of 25 hours and no change in the permeability was observed.

During the combustion experiments the gaseous downstream of the panel were sampled and analyzed for nitrogen oxides. In the surface combustion mode peak concentrations were found immediately downstream of the surface. The concentrations of NO found were very low, between 12 and 24 ppmv at 200 and 600 kW $m^{-2}$, respectively, this is due to the relatively low combustion temperature attained in the surface combustion mode. In free-flame mode of operation the NO values were much higher at between 150 and 250 ppmv, with the peak concentration occurring some 150 mm downstream of the surface. Such concentrations are typical of conventional premixed gas burners where flame temperature close to the adiabatic value are reached.

The limit of high temperature operation for a surface-combustion burner is reached when unstable interstitial combustion, which leads to flash back, occurs. The maximum stable surface temperature was determined by enclosing the burner in a furnace box in such a way as to reduce the radiation loss progressively, and recording the surface temperature at the point of instability. At a thermal input of 400 kW $m^{-2}$ this maximum stable surface temperature was found to be 1420 K and this increased to 1520 K at 800 kW $m^{-2}$.

All the above results are for the 6 mm thick panel, the 4 mm panel differed in its performance only in that a lower pressure drop was obtained. Each of the panels consisted of 22 micron diameter fibers of steel containing 15.8% w chromium, 4.8% w aluminum, 0.3% w carbon and 0.3% w yttrium.

In a preferred embodiment, a radiant surface combustion burner according to the invention has a fibrous porous element comprising a sintered wall of non-woven steel fibers containing chromium and aluminum. The fibrous porous element consists of a flat panel or cylindrical wall of non-woven structure made by compressing a more or less randomly packed structure of steel fibers containing chromium and aluminum into a flat sheet or panel and subsequently sintering it to obtain strength, coherence and stability of form and permeability. Such sintered panels or sheets have the additional advantage of being deformable, machineable and weldable. The panels can be brought into their ultimate form either before or after sintering. Since steels containing chromium and aluminum have a high oxidation resistance at elevated temperature and are resistant to thermal cycling as it occurs in radiant surface combustion burner elements, the initial mechanical strength of the fibrous porous elements according to the invention is maintained over long periods of time and embrittlement does not occur.

Typically, with the fibrous porous elements according to the invention, proosities of 60–90% are used. Much preference is given to very thin fibers, having diameters of below 50 mircon, and this typically leads to densities of between 300 and 3000 kg/$m^3$. Metallic wire mesh is much more difficult to transform into porous elements of the desired properties than non-woven fibers.

Surprisingly, the radiant burners according to the invention can be operated with thermal inputs of between 100 and 1000 kW$m^{-2}$, whereas radiant surface combustion burners using ceramic fiber porous elements can only be operated between 100 and 400 kW$m^{-2}$ thermal input (thermal input per $m^2$ porous element radiant surface).

It is possible to make thinner porous elements with sintered non-woven steel fibers than with ceramic fibers and thus to obtain a lower resistance to flow of the porous element.

Radiant surface combustion burners normally comprise a frame of impermeable material to support the porous element and conduit means to conduct the combustible gas mixture into a gas distributing space enclosed by the frame and/or the porous element. As the front surface layer of the porous element is the reaction zone the fibrous porous element of the present burners are preferably made relatively thin, e.g. a few millimeters. And, a support in the form of a backing of less resistant porous material is attached to the fibrous porous element's rear surface. Such a backing member can have an yttrium-free composition, such as that of a perforated metal plate of the type described in British Patent Application No. 2,120,771A.

The frame part of the radiant burner is suitably made from a metal, such as stainless steel, and can be fabricated, pressed or otherwise formed into the required shape to support the porous element and to form a plenum for the gas-mixture. The porous element can be secured to the frame part in any suitable manner, such as by bolting, locking or welding.

What is claimed is:

1. A surface-combustion radiant burner comprising a frame of impermeable material supporting a porous element which is permeable to gas and has a front surface for producing radiant heat and conduit means for conducting a combustible gas mixture into a gas distributing space enclosed by the frame and into and through the porous element for effecting combustion near its front surface, wherein the porous element is formed of metal fibers of an alloy containing 15.0 to 22.0% w chromium, 4.0 to 5.2% w aluminum, 0.05 to 0.4% w yttrium, 0.2 to 0.4% w silicon, less than 0.03% w carbon and the balance iron and having the property of forming an alumina layer on being heated in the presence of oxygen.

2. A surface-comburtion radiant burner according to claim 1, wherein the metal fibers are laid in planes substantially normal to the direction of flow of the gas being combusted.

3. A surface-comburtion radiant burner according to claim 2, wherein the fibrous porous element is formed of fibers having diameters below about 50 microns.

4. In the process of burning a mixture of air and gas in a surface combustion radiant burner at a temperature exceeding about 1200 degrees Kelvin; an improvement for retaining the stress resistance of porous metal media while minimizing nitrogen oxide production and burner corrosion, comprising:

using a porous burner element permeable to gas which is formed of metal fibers of an alloy containing 15.0 to 22.0% w chromium, 4.0 to 5.2% w aluminum, 0.05 to 0.4% w yttrium, 0.2 to 0.4% w silicon, less than 0.03% w carbon and the balance iron in ratios providing a property of forming an aluminum layer on being heated in the presence of oxygen.

5. The process of claim 4 in which the metal particles forming the fibrous porous element comprise a substantially rigid panel of randomly laid fibers having diameters of about 22 $\mu$m and porosites of about 80 percent.

6. The process of claim 5 in which the combustion is conducted at a thermal input range of about 100 to 1000 kW$m^{-2}$ based on the gross calorific value of the gas and the superficial area of the fibrous porous material surface.

* * * * *